United States Patent [19]

Osaka et al.

[11] Patent Number: 4,538,897

[45] Date of Patent: Sep. 3, 1985

[54] LATENT ELECTROSTATIC IMAGE DEVELOPING APPARATUS

[75] Inventors: Haruya Osaka; Takashi Maekawa, both of Osaka; Yoshihiro Nakajima, Daito, all of Japan

[73] Assignee: Mita Industrial Co., Ltd., Osaka, Japan

[21] Appl. No.: 472,121

[22] Filed: Mar. 4, 1983

[30] Foreign Application Priority Data

Mar. 31, 1982 [JP] Japan ..... 57-51259

[51] Int. Cl.[3] ..... G03G 15/00

[52] U.S. Cl. ..... 355/3 DD; 355/14 D; 118/688; 118/689

[58] Field of Search ..... 355/14 D; 118/688, 689, 118/690; 355/3 DD

[56] References Cited

U.S. PATENT DOCUMENTS

| | | | |
|---|---|---|---|
| 3,932,034 | 1/1976 | Takahashi | 355/3 DD |
| 4,168,901 | 9/1979 | Ito et al. | 355/3 DD |
| 4,183,657 | 1/1980 | Erust et al. | 355/14 R |
| 4,194,828 | 3/1980 | Hölz et al. | 355/3 DD |
| 4,226,525 | 10/1980 | Sakamoto et al. | 355/14 D |
| 4,343,548 | 8/1982 | Bares et al. | 355/3 DD |

*Primary Examiner*—A. T. Grimley
*Assistant Examiner*—David S. Warren
*Attorney, Agent, or Firm*—Wenderoth, Lind & Ponack

[57] ABSTRACT

An apparatus for developing a latent electrostatic image comprises a developer receptacle containing a developer composed of carrier particles and toner particles, a developer applying mechanism for holding on its surface a part of the developer in the developer receptacle and applying it to a latent electrostatic image to be developed, a toner receptacle containing toner particles, and a toner supplying mechanism to be selectively operated to supply toner particles to the developer in the developer receptacle from the toner receptacle. A detector detects the electrical conductivity of the developer in the developer receptacle. The apparatus further includes at least one of (a) a toner exhaustion signal producing device which, when the electrical conductivity of the developer detected by the detector exceeds a predetermined toner exhaustion reference value, produces a signal showing that the toner particles contained in the toner receptacle have been exhausted, (b) a carrier degradation signal producing device which, when the electrical conductivity of the developer detected by the detector falls below a predetermined carrier degradation reference value, produces a signal showing that the carrier particles in the developer have been degraded, and (c) a toner supplying signal producing device which, when the electrical conductivity of the developer detected by the detector exceeds a predetermined toner supply reference value, produces a signal for operating the toner supplying mechanism and a carrier degradation signal producing means which, when the toner supplying signal producing device does not continue to produce the signal in spite of the fact that the latent electrostatic image has been developed a predetermined number of times, produces a signal showing that the carrier particles in the developer have been degraded.

10 Claims, 3 Drawing Figures

LATENT ELECTROSTATIC IMAGE DEVELOPING APPARATUS

FIELD OF THE INVENTION

This invention relates to an apparatus for developing a latent electrostatic image, and more specifically, to a latent electrostatic image developing apparatus of the type in which a two-component developer composed of carrier particles and toner particles is used.

DESCRIPTION OF THE PRIOR ART

As is well known to those skilled in the art, a developing apparatus of the type in which a two-component developer composed of carrier particles and toner particles is used has previously gained widespread commercial acceptance for developing a latent electrostatic image in electrostatic copying apparatuses and the like. This type of developing apparatus generally comprises a developer receptacle containing a developer, a developer applying mechanism for holding a part of the developer in the developer receptacle on its surface and applying it to a latent electrostatic image to be developed, a toner receptacle containing toner particles, and a toner supplying mechansim to be selectively operated to supply toner particles from the toner receptacle to the developer in the developer receptacle.

It is important in the aforesaid developing apparatus to maintain the ratio of carrier particles and toner particles in the developer contained in the developer receptacle within a predetermined range by properly operating the toner supplying mechanism as the toner particles in the developer are consumed by the performance of development, and thereby properly supplying toner particles from the toner receptacle to the developer in the developer receptacle. The developer applying mechanism in the aforesaid developing apparatus holds on its surface a developer composed of carrier particles and toner particles. As is well known to those skilled in the art, only the toner particles intrinsically adhere to a latent electrostatic image; therefore, only the toner particles are consumed as the development is carried out, and the carrier particles remain substantially unconsumed. As a result, when the development is repeatedly performed without supplying toner particles to the developer in the developer receptacle, the proportion of the toner particles in the developer becomes excessively low. This eventually reduces the developing density of the resulting developing image and causes inconveniences such as the phenomenon of insufficient development. On the other hand, when excessive toner particles are supplied to the developer in the developer receptacle from the toner receptacle, and the proportion of the toner particles in the developer increases excessively, inconveniences, such as the occurrence of background fogging in the developed image, are caused.

In the prior art, too, the ratio between carrier particles and toner particles in the developer in the developer receptacle is detected by various methods, and based on this detection, the operation of the toner supplying mechanism ( the supplying of toner particles to the developer in the developer receptacle from the toner receptacle) is controlled to maintain the ratio between carrier particles and toner particles in the developer contained in the developer receptacle at a predetermined value. For example, according to the developing apparatus disclosed in Japanese Laid-Open Patent Publication No. 122277/1975, special attention is paid to the relation between the ratio of carrier particles and toner particles in the developer and the electrical conductivity of the developer (such a relationship that when the proportion of the toner particles decreases, the electrical conductivity of the developer increases, and when the proportion of the toner particles increases, the electrical conductivity of the developer decreases), and the electrical conductivity of the developer in the developer receptacle is detected and the operation of the toner supplying mechanism is controlled on the basis of the detected conductivity.

The conventional developing apparatus is not entirely satisfactory, and has the following defects or problems.

Firstly, in the aforesaid developing apparatus, the operation of the toner particles supplying mechanism is controlled on the basis of the ratio between carrier particles and toner particles in the developer within the developer receptacle. Accordingly, if only the toner particles are properly supplied to the developer in the developer receptacle from the toner particles receptacle in response to the operation of the toner particles supplying mechanism, the ratio between carrier particles and toner particles in the developer contained in the developer receptacle is maintained within a predetermined range. However, when the toner particles contained in the toner receptacle itself are used up, the operation of the toner supplying mechanism naturally does not result in the supplying of toner particles to the developer in the developer receptacle. In the conventional developing apparatus, the exhaustion of the toner particles contained in the toner receptacle is not detected, and frequently, the operation performs development repeatedly without being aware that the toner particles in the toner receptacle have been used up. If this happens, the proportion of the toner particles in the developer in the developer receptacle gradually decreases with the performance of development, and therefore, the developing density of the developed image gradually decreases to cause inconveniences such as the phenomenon of insufficient development.

Secondly, as is well known to those skilled in the art, the carrier particles in the developer undergo degradation because, for example, toner particles adhering to the carrier particles fail to separate when the development is performed repeatedly over a long period of time. When the carrier particles are degraded, the quality of the developed image is necessarily reduced. However, in the conventional developing apparatus, the degradation of the carrier particles in the developer contained in the developer receptacle is not detected, and the operator frequently performs development repeatedly without noticing the degradation of the carrier particles.

SUMMARY OF THE INVENTION

It is an object of this invention to provide a novel and excellent apparatus for developing a latent electrostatic image, which, when toner particles contained in a toner receptacle have been used up and it is necessary to supply further toner particles to the toner receptacle, can detect such condition and warn the operator.

Another object of this invention is to provide a novel and excellent apparatus for developing a latent electrostatic image, which, when carrier particles in a developer contained in a developer receptacle have been degraded an it is necessary to exchange them, can detect such condition and warn the operator.

Other objects of this invention will become apparent from the following description made with reference to the accompanying drawings.

Extensive investigations of the present inventors have led to the discovery that the exhaustion of toner particles contained in the toner receptacle itself and the degradation of the carrier particles in the developer contained in the developer receptacle are related to the electrical conductivity of the developer in the developer receptacle, and that when the electrical conductivity of the developer in the developer receptacle is detected and compared with specified reference value, the exhaustion of the toner particles and the degradation of the carrier particles can be detected.

Thus, according to this invention, there is provided an apparatus for developing a latent electrostatic image, comprising a developer receptacle containing a developer composed of carrier particles and toner particles, a developer applying mechanism for holding on its surface a part of the developer in the developer receptacle and applying it to a latent electrostatic image to be developed, a toner receptacle containing toner particles, and a toner supplying mechanism to be selectively operated to supply toner particles to the developer in the developer receptacle from the toner receptacle; characterized in that the apparatus further comprises a detecting means for detecting the electrical conductivity of the developer in the developer receptacle in combination with at least one of (a) a toner exhaustion signal producing means which, when the electrical conductivity of the developer detected by said detecting means exceeds a predetermined toner exhaustion reference value, produces a signal showing that the toner particles contained in the toner receptacle have been exhausted, (b) a carrier degradation signal producing means which, when the electrical conductivity of the developer detected by said detecting means falls below a predetermined carrier degradation reference value, produces a signal showing that the carrier particles in the developer have been degraded, and (c) a toner supplying signal producing means which, when the electrical conductivity of the developer detected by said detecting means exceeds a predetermined toner supplying reference value, produces a signal for operating the toner supplying mechanism and a carrier degradation signal producing means which, when said toner supplying signal producing means does not continue to produce said signal in spite of the fact that the latent electrostatic image has been developed a predetermined number of times, produces a signal showing that the carrier particles in the developer have been degraded.

Conveniently, but not altogether necessary when the apparatus includes means (a) and/or means (b), the developing apparatus of this invention may further comprise a toner supplying signal producing menas which, when the electrical conductivity of the developer detected by the aforesaid detecting means exceeds a predetermined toner supplying reference value which is lower than the aforesaid toner exhaustion reference value but higher than the aforesaid carrier degradation reference value, produces a signal for operating the aforesaid toner supplying mechanism.

DETAILED DESCRIPTION OF THE PREFERRED EMBODIMENTS

The invention is described below in detail with reference to the accompanying drawings showing preferred embodiments of the latent electrostatic image developing apparatus constructed in accordance with this invention.

Figure 1:
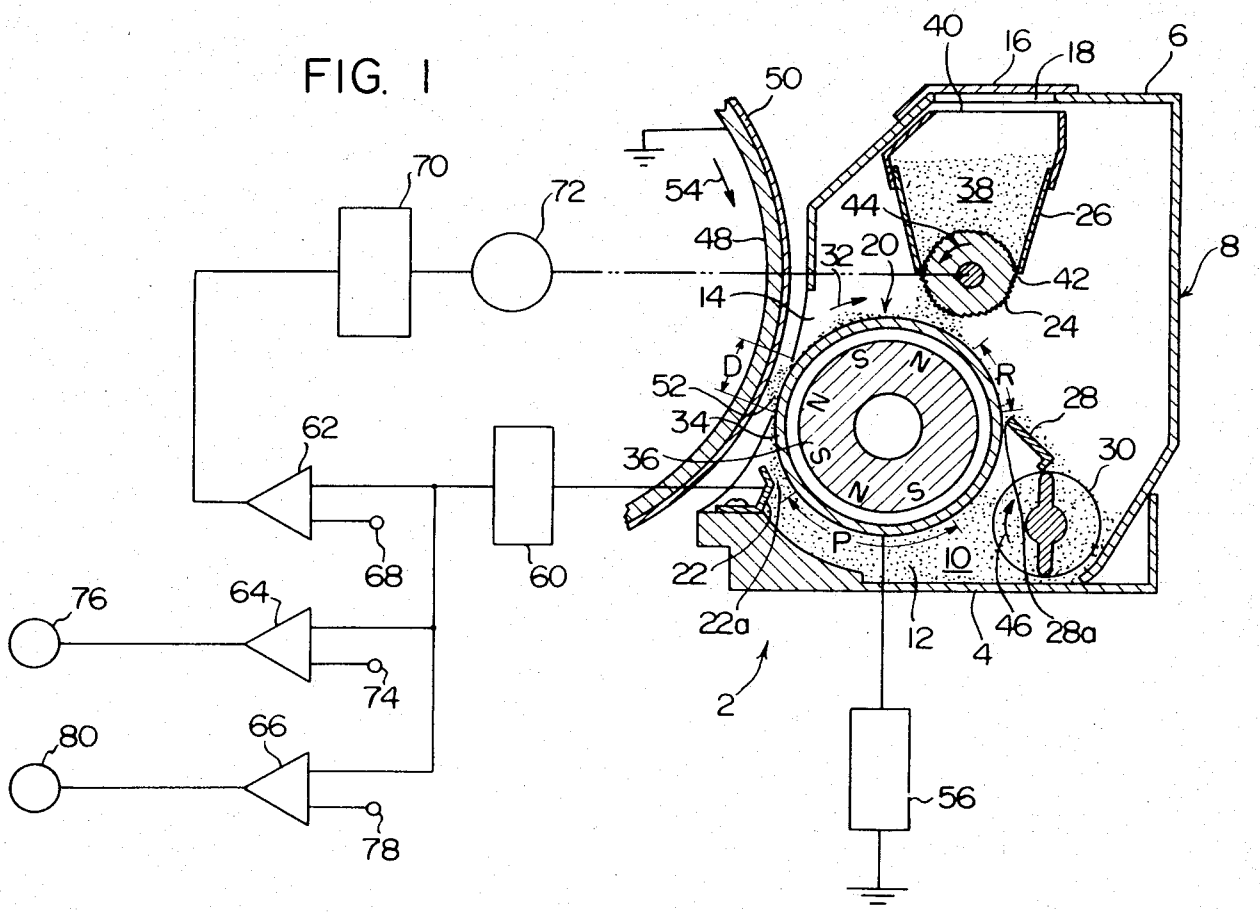
FIG. 1 is a simplified view of one embodiment of the latent electrostatic image developing apparatus constructed in accordance with this invention which is partly shown by a sectional view and partly by a block diagram.

With reference to FIG. 1, the illustrated developing apparatus shown generally at 2 has a development housing 8 having a dish-like lower plate 4 made of an electrically nonconductive material and an upper cover plate 6 made of an electrically nonconductive material. The lower part of the development housing 8 constitutes a developer receptacle 12 for receiving a two-component developer 10 composed of magnetic carrier particles and toner particles. An opening 14 is formed in the front side of the housing 8, and an opening 18 adapted to be closed by an openable door 16 is formed on the top side of the housing 8.

A developer applying mechanism 20 is disposed within the development housing 8. There are also disposed within the housing 8 a brush length-setting member 22, a toner receptacle 26 having a toner supplying mechanism 24 annexed thereto, a peeling member 28 and a rotary agitating mechanism 30, which are positioned around the developer applying mechanism 20 in relation thereto.

The developer applying mechanism 20 in the illustrated embodiment includes a rotary sleeve member 34 mounted rotatably and adapted for rotation in a direction shown by an arrow 32 and a stationary permanent magnet 36 disposed within the rotary sleeve member 34. The stationary permanent magnet 36 is in a roll form, and has six magnetic poles spaced circumferentially along its peripheral edge portion, i.e. three S poles and three N poles located alternately.

The brush length-setting member 22 formed of an electrically conductive material is positioned such that its angled portion shown by 22*a* is spaced a distance of preferably about 0.5 to 3.0 mm from the surface of the rotary sleeve member 34. It sets the amount of a developer 10 held on the surface of the rotary sleeve member 34, i.e. the magnetic brush length, as will be described hereinbelow. The brush length-setting member 22 is mounted on the front end portion of the lower plate 4 of the housing 8 so that the aforesaid distance can be finely adjusted as required, and, for example, its position in the left and right directions in FIG. 1 can be finely adjusted.

The toner receptacle 26 for receiving and holding toner particles 38 has a toner supplying opening 40 at its top side and a toner discharge opening 42 at its bottom side, and a toner supplying mechanism 24 is disposed at the toner discharge opening 42 of the toner receptacle 26. The toner supplying mechanism 24 is constructed of a rotatably mounted roller on the circumferential surface of which many depressions or grooves are formed, for example by knurling. As will be described hereinbelow, the toner supplying mechanism 24 is selectively operated and rotated in the direction of an arrow 44.

Upon rotation, the toner particles 38 are delivered from the toner receptacle 26 while they are received in the many depressions or grooves present on the circumferential surface of the toner supplying mechanism 24, then let fall into the surface of the rotary sleeve member 34, and thus supplied to the developer 10 in the developer receptacle 12. Supplying of the toner particles 38 to the toner receptacle 26 itself is carried out by opening the door 16 privided on the top side of the housing 8, and filling toner particles 38 into the toner receptacle 26 through the opening 18 and the toner supplying opening 40.

The peeling member 28 fixed in position within the development housing 8 has a tip portion 28*a* in contact with, or in proximity to, the surface of the rotary sleeve member 34, and as will be described hereinbelow, by the action of the tip portion 28*a* on the developer 10 present on the surface of the rotary sleeve member 34, the developer 10 is surely peeled off from the surface of the rotary sleeve member 34.

The rotary agitating mechanism 30 is constructed of a rotary agitating member which is rotatably mounted and rotated in the direction shown by an arrow 46.

The developing apparatus 2 described above can be utilized as a developing apparatus for applying toner particles to a latent electrostatic image formed by a suitable method known per se on an electrophotographic material 50 (only a part of which is illustrated) disposed on the peripheral surface of a rotating drum 48 (only a part of which is illustrated likewise) mounted rotatably in the housing of an electrostatic copying apparatus (not shown) to develop it into a visible image. In this case, the developing apparatus 2 is disposed such that as shown in FIG. 1, the opening 14 formed in the front side of the housing 8 faces the electrophotographic material 50. As the rotary sleeve member 34 rotates in the direction of arrow 32, the developing apparatus 2 performs the following actions. First of all, in a developer pumping zone shown by P, the developer 10 existing in the developer receptacle 12 is attracted to, and held by, the surface of the rotary sleeve member 34 by the magnetic attracting force of the permanent magnet 36, whereby a magnetic brush 52 of the developer 10 is formed on the surface of the rotary sleeve member 34. The brush length of the magnetic brush 52 is adjusted to the desired length by the action of the brush length-setting member 22. Afterward, in a developing zone shown by D, the magnetic brush 52 is brought into contact with the surface of the electrophotographic member 50 rotated in the direction of an arrow 54. As a result, toner particles in the magnetic brush 52 are applied to a latent electrostatic image formed on the electrophotographic material 50 to develop it into a visible image. Then, in a developer peeling zone shown by R, the developer 10 forming the magnetic brush 52 is peeled from the surface of the rotary sleeve member 34 since in the peeling zone R, no magnetic pole of the permanent magnet 36 exists and moreover, a magnetic field, even if present, is extremely small and the peeling member 28 acts on the magnetic brush 52 on the rotary sleeve member 34. The developer 10 thus peeled flows down along the upper surface of the peeling member 28 and drops towards the rotary agitating mechanism 30. The rotary agitating mechanism 30 agitates the developer 10 to mix the carrier particles and the toner particles therein uniformly and triboelectrically charge the toner particles to, for example, a negative polarity.

The aforesaid construction and operation of the developing apparatus 2 does not constitute the novel improvement of th developing apparatus constructed in accordance with the invention, but merely show one example of the developing apparatus to which the present invention is applied.

Further with reference to FIG. 1, the developing apparatus 2 includes a detecting means for detecting the electrical conductivity (which also includes the effect of a charge in the developer 10 caused by triboelectric charging) of the developer 10 in the developer receptacle 12. In the illustrated embodiment, a voltage source 56 is electrically interposed between the rotary sleeve member 34 of the developer applying mechanism 20 and the ground, and the brush length-setting member 22 made of an electically conductive material is also utilized as a counter electrode. The voltage source 56 applies a DC voltage, which may, for example, be about 200 V, to the rotary sleeve member 34. The electrical conductivity of the developer 10 in the developer receptacle 12 can be detected by detecting an electric current flowing through the developer 10 existing between the rotary sleeve member 34 and the brush length-setting member 22.

In the illustrated embodiment, a rotating drum 48 made of an electrically conductive material and having the electrophotographic material 50 disposed around its circumferential surface is grounded. Hence, the voltage source 56 functions not only as a voltage source for detecting the electrical conductivity of the developer 10 in the developer receptacle 12 but also as a development bias voltage source for applying a development bias voltage known per se across the rotary sleeve member 34 and the electrophotographic material 50 in the developing zone D in order to prevent the occurrence of so-called background fog in development.

Figure 2:
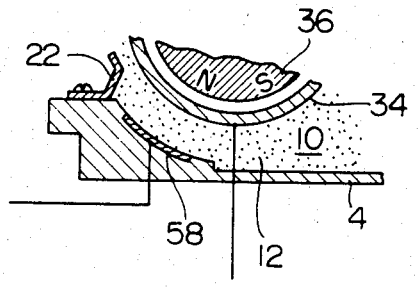
FIG. 2 is a simplified sectional view showing a modified example of a counter electrode.

The counter electrode for detecting the current flowing through the developer 10 in the developer receptacle 12 may be constructed of another suitable member instead of the brush length-setting member 22 described above. For example, as shown in FIG. 2, the counter electrode may be constructed of an electrically conductive member 58 which is embedded in the upper surface of the dish-like lower plate 4 defining the bottom surface of the developer receptacle 12. In some cases, it is possible to form the dish-like plate 4 itself from an electrically conductive material and use the plate 4 itself as the counter electrode. It is also possible, as disclosed in Japanese Laid-Open Patent Publication No. 122277/1975 cited above, to dispose an electrically conductive member at a sutiable site within the developer receptacle 12 and construct the counter electrode from this conductive member. However, with this construction, the flowing of the developer 10 in the developer receptacle 12 is inhibited by the conductive member constituting the counter electrode, and some adverse effect is likely to be exerted on the performance of development.

In the embodiment illustrated in FIG. 1, the counter electrode made up of the brush length-setting member 22 is electrically connected to a toner supplying signal producing means 62, a toner exhaustion signal producing means 64 and a carrier degradation signal producing means 66 through a noise filter 60 known per se which can be constructed of, for example, an intergrating curcuit. Accordingly, the current flowing through the developer 10 existing between the rotary sleeve member 34 and the brush length-setting member 22 is supplied to the toner supplying signal producing means 62, the toner exhaustion signal producing means 64 and the carrier degradation signal producing means 66 after noises have been removed by the noise filter 60.

The toner supplying signal producing means 62 is constructed of a comparator having a first input terminal connected to the brush length-setting member 22 through the noise filter 60 and a second input terminal connected to a reference voltage source 68. The toner supplying signal producing means 62 converts an electric current supplied to the first input terminal into a voltage, compares it with the reference voltage ($V_1$) from the reference voltage source 68, and when the former exceeds the latter, produces a signal at its output terminal.

As disclosed also in Japanese Laid-Open Patent Publication No. 122277/1975 cited above, the electrical conductivity of the toner particles is lower than that of the carrier particles. Hence, as the proportion of the toner particles in the developer 10 within the developer receptacle 12 decreases, the electrical conductivity of the developer 10 increases, and as the proportion of the toner particles increases, the electrical conductivity of the developer 10 decreases. Accordingly, when the toner particles in the developer 10 within the developer receptacle 12 are consumed with the performance of development and the proportion of the toner particles in the developer 10 decreases, an electric current supplied to the first input terminal of the toner supplying signal producing means 62 increases. On the other hand, the reference voltage ($V_1$) of the reference voltage source 68 is set at a value corresponding to a toner supplying reference value which is the electrical conductive of the developer 10 at a time when the proportion of the toner particles in the developer 10 within the developer receptacle 12 decreases to a value which necessitates the supplying of toner particles to the developer 10. Accordingly, when the electrical conductivity of the developer 10 in the developer receptacle 12 exceeds the toner particle supplying reference value and the toner particles have to be supplied to the developer 10, a toner supplying signal is produced at the output terminal of the toner supplying signal producing means 62.

The toner supplying signal is supplied to a control circuit 70 for controlling the operation of the toner supplying mechanism 24. When the toner supplying signal is fed to the control circuit 70, an electric motor 72 for operating the toner supplying mechanism 24 is energized for a time period corresponding to the time period during which the toner supplying signal exists, or a predetermined period of time properly prescribed. As a result, the toner supplying mechanism 24 is rotated in the direction of arrow 44, and the toner particles 38 in the toner receptacle 26 are supplied to the developer 10 in the developer receptacle 12.

Accordingly, the proportion of toner particles in the developer 10 is maintained within a predetermined range if only the operation of the toner supplying mechanism 24 is controlled on the basis of the proportion of the toner particles in the developer 10 within the developer receptacle 12 and therefore the toner particles 38 in the toner receptacle 26 are properly supplied to the developer 10 in response to the operation of the toner supplying mechanism 24. However, when the toner particles 38 contained in the toner receptacle 26 are exhausted, the operation of the toner supplying mechanism 24 naturally fails to effect supplying of the toner particles 38 to the developer 10, and the proportion of the toner particles in the developer 10 decreases excessively below the desired limit.

In the developing apparatus 2 constructed in accordance with this invention, the toner exhaustion signal producing means 64 produces a signal when the toner particles 38 contained in the toner receptacle 26 have been used up, and the proportion of the toner particles in the developer 10 has decreased excessively below the desired limit.

The toner exhaustion signal producing means 64 is constructed of a comparator having a first input terminal connected to the brush length-setting member 22 through the noise filter 60, and a second input terminal connected to a reference voltage source 74. The toner exhaustion signal producing means 64 converts an electric current supplied to the first input terminal into a voltage, compares it with the reference voltage ($V_2$) from the reference voltage source 74, and when the former exceeds the latter, produces a signal at its output terminal.

When the toner particles 38 contained in the toner receptacle 26 have been exhausted, the proportion of the toner particles in the developer 10 decreases excessively below the desired limit as stated hereinabove. Hence, the electrical conductivity of the developer 10 increases excessively, and the electric current fed to the first input terminal increases excessively. On the other hand, the reference voltage ($V_2$) is higher than the reference voltage ($V_1$) of the reference voltage source 68 relating to the toner supplying signal producing means 62 and is set at a value corresponding to a toner exhaustion reference value which is the electrical conductivity of the developer 10 at a time when the proportion of the toner particles in the developer 10 has excessively decreased. Hence, the toner exhaustion signal producing means 64 produces a toner exhaustion signal at its output terminal when the toner particles 38 in the toner receptacle 26 have been exhausted and the electrical conductivity of the developer 10 has excessively increased and exceeded the toner exhaustion reference value.

The toner particles exhaustion signal is fed to a suitable alarm 76 such as an alarm lamp or an alarm sound generator, and consequently, the operator is warned of the fact that the toner particles 38 in the toner receptacle 26 are exhausted and it is necessary to supply toner particles 38 to the toner receptacle 26.

As already stated hereinabove, when the development is repeated over a long period of time, the carrier particles in the developer 10 within the developer receptacle 12 are degraded owing, for example, to the inability of toner particles adhering to the carrier particles to separate therefrom. When the carrier particles are degraded, the quality of the developed image is naturally lowered.

In the illustrated embodiment constructed in accordance with this invention, the carrier degradation signal producing means 66 produces a signal when the carrier particles in the developer 10 have been degraded and have to be exchanged.

In more detail, the carrier degradation signal producing means 66 is constructed of a comparator having a first input terminal connected to the brush length-setting member 22 through the noise filter 60 and a second input terminal connected to a reference voltage source 78. The carrier degradation signal producing means 66 converts an electric current supplied to the first input terminal into a voltage, compares it with the reference voltage ($V_3$) supplied to the second input terminal from the reference voltage 78, and when the former becomes lower than the latter, produces a signal at its output terminal.

When the carrier particles in the developer 10 within the developer receptacle 12 are degraded owing, for example, to the inability of the toner particles adhering to the carrier particles to separate therefrom, the electrical conductivity of the developer 10 excessively decreases and approaches that of the toner particles alone. Hence, the electric current supplied to the carrier degradation signal producing means 66 excessively decreases. On the other hand, the reference voltage ($V_3$) of the reference voltage source 78 is lower than the reference voltage ($V_1$) of the reference voltage source 68 relating to the aforesaid toner supplying signal producing means 62 by a predetermined amount or larger, and is set at a value corresponding to a carrier degradation reference value which is the electrical conductivity of the developer 10 at a time when the carrier particles in the developer 10 have been degraded and have to be exchanged. Accordingly, the carrier degradation signal producing means 66 produces a carrier degradation signal at its output terminal when the carrier particles in the developer 10 have been degraded and have to be exchanged, and as a result, the electrical conductivity of the developer 10 has excessively decreased and fallen below the carrier degradation reference value.

The carrier degradation signal is fed to a suitable alarm 80 such as an alarm lamp or an alarm sound generator, and consequently, the operator is warned of the fact that the carrier particles in the developer 10 within the developer receptacle 12 have been degraded and have to be exchanged.

If desired, a carrier particle receptacle (not shown) and a carrier particle supplying mechanism (not shown) for supplying carrier particles in the receptacle to the developer 10 in the developer receptacle 12 may be provided further in the upper portion of the inside of the development housing 8 so that when the aforesaid carrier degradation signal is produced, the carrier supply mechanism is operated in response thereto to supply the carrier particles in the carrier particle receptacle to the developer 10 in the developer receptacle 12, thereby temporarily preventing a reduction in the quality of the developed image before the carrier particles in the developer 10 are exchanged with new ones.

Figure 3:
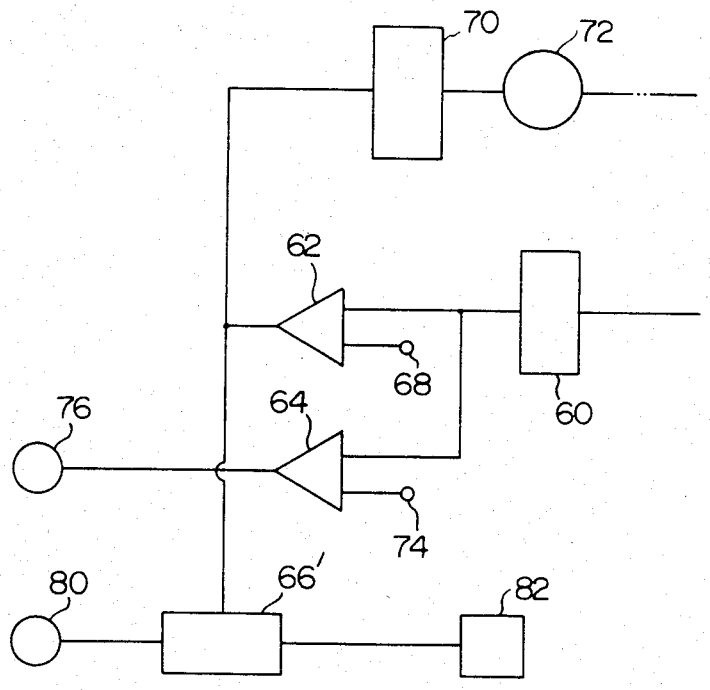
FIG. 3 is a simplified partial block diagram showing a modified example of the carrier degradation signal producing means.

FIG. 3 illustrates a modified example of the carrier degradation signal producing means. A carrier particle degradation signal producing means 66' shown in FIG. 3 is constructed of a counter having two input terminals and one output terminal. One of the two input terminals is connected to the output terminal of the aforesaid toner supplying signal producing means 62. When the toner supplying signal producing means 62 produces a toner supplying signal at its output terminal, this toner supplying signal is supplied to the control circuit 70 and also fed into one input terminal of the carrier degradation signal producing means 66'. The other of the two input terminals is connected to the output terminal of a signal generator 82 which produces a signal every time a latent electrostatic image is developed by the developing apparatus 2. When the developing apparatus 2 is built in an ordinary electrostatic copying apparatus, the development of a latent electrostatic image by the developing apparatus 2 is performed every time the copying process is performed by the electrostatic copying apparatus. Accordingly, for example, a copying cycle detector known per se which, every time a document support stand (or at least a part of an optical unit) is moved as required for the scanning exposure of a document to be copied, detects such movement and produces a signal can be utilized as the signal generator 82. The carrier degradation signal producing means 66' constructed of a counter counts the signal supplied from the signal generator 82, but is reset when the toner supplying signal is fed from the toner supply signal producing means 62. When it counts a number n which may, for example, be 15, it produces a carrier degradation signal at the output terminal.

When the latent electrostatic image is developed as described above, the toner particles in the developer 10 within the developer receptacle 12 are consumed as a result of their application to the latent electrostatic image, and the proportion of the toner particles in the developer 10 decreases. Hence, when the development is repeated at least several times, the proportion of toner particles in the developer 10 decreases considerably, and correspondingly, in a normal case, the electrical conductivity of the developer 10 increases and exceeds the aforesaid toner supplying reference value. Consequently, the toner supplying signal producing means 62 produces a toner supplying signal. When, however, the carrier particles in the developer 10 have been degraded and need to be exchanged, the electrical conductivity of the developer 10 decreases considerably owing to the degradation of the carrier particles. In such a case, even when the proportion of the toner particles in the developer 10 decreases considerably as a result of the n times development of a latent electrostatic image, the increase of the electrical conductivity of the developer 10 due to the decrease of the proportion of the toner particles is offset by the decrease of the electrical conductivity of the developer 10 due to the degradation of the carrier particles, and the electrical conductivity of the developer 10 does not exceed the toner particle supplying reference value. For this reason, when the development of the latent electrostatic image is repeated n times, the toner supplying signal producing means 62 does not produce a toner supplying signal during this time, and thus, the carrier degradation signal producing means 66' produces a carrier degradation signal at its output terminal.

The carrier particle degradation signal produced by the carrier particle degradation signal producing means 66', like the carrier degradation signal produced by the carrier degradation signal producing means 66 shown in FIG. 1, is fed to a suitable alarm 80 such as an alarm lamp or an alarm sound generator. Thus, the operator is warned of the fact that the carrier particles in the developer 10 within the developer receptacle 12 have been degraded and have to be exchanged.

The carrier degradation signal producing means 66' shown in FIG. 3 is superior to the carrier degradation signal producing means 66 shown in FIG. 1 with respect to the following.

When the developing apparatus is set out of operation for a long period of time, a considerable amount of the electric charge on the developer 10 generated by triboelectrical charging disappears. Because of this, the electrical conductivity of the developer 10 may decrease and fall below the carrier degradation reference value even when the carrier particles are not degraded and the proportion of the toner particles in the developer 10 does not excessively increase. It is possible therefore that the carrier degradation signal producing means 66 illustrated in FIG. 1 will erroneously produce a carrier degradation signal temporarily in spite of the carrier particles being not degraded, when the operation of the developing apparatus is resumed after suspension for a long period of time. Of course, the erroneously produced carrier degradation signal will disappear when the development of the latent electrostatic image is performed by resuming the operation and the developer 10 is triboelectrically charged by the agitating action of the rotary agitating mechanism 30 and consequently the electrical conductivity of the developer 10 returns to its normal value. In contrast, the carrier degradation signal producing means 66' illustrated in FIG. 3 produces a carrier degradation signal when the toner supplying signal producing means 62 does not produce a toner supplying signal during the repetition of the development of a latent electrostatic image through n cycles. Hence, even upon resumption of the operation after suspension for a long period of time, the carrier degradation signal producing means 66' is quite unlikely to produce a carrier particle degradation signal erroneously.

While the present invention has been described in detail hereinabove with reference to the specific embodiments of the latent electrostatic developing apparatus constructed in accordance with this invention taken in conjunction with the accompanying drawings, it should be understood that the present invention is not limited to these specific embodiments, and various changes and modifications are possible without departing from the scope of this invention.

What is claimed is:

1. In an apparatus for developing a latent electrostatic image, said apparatus being of the type comprising a developer receptacle containing a developer composed of carrier particles and toner particles, a developer applying mechanism for holding on its surface a part of the developer in the developer receptacle and applying it to a latent electristatic image to be developed, a toner receptacle containing toner particles, and a toner supplying mechanism to be selectively operated to supply toner particles to the developer in the developer receptacle from the toner receptacle, the improvement wherein said apparatus further comprises:

detecting means for detecting the electrical conductivity of the developer in said developer receptacle; and carrier degradation signal producing means for, when the electrical conductivity of the developer detected by said detecting means falls below a predetermined carrier degradation reference value, producing a signal showing that the carrier particles in the developer have been degraded.

2. The apparatus of claim 1 which further comprises toner supplying signal producing means for, when the electrical conductivity of the developer detected by said detecting means exceeds a predetermined toner supplying reference value higher than said carrier degradation reference value, producing a signal for operating said toner supplying mechanism.

3. The apparatus of claim 1, which further comprises toner exhaustion signal producing means for, when the electrical conductivity of the developer detected by said detecting means exceeds a predetermined toner exhaustion reference value higher than the carrier degradation reference value, producing a signal showing that the toner particles in said toner receptacle have been exhausted.

4. The apparatus of claim 1, wherein said detecting means includes a voltage source for applying a predetermined voltage to said developer applying mechanism, and a counter electrode located opposite to said developer applying mechanism, with the developer existing between said voltage source and said counter electrode.

5. The apparatus of claim 4, wherein said counter electrode is constructed of a brush length-setting member for setting the amount of the developer to be held on the surface of said developer applying mechanism.

6. The apparatus of claim 4, wherein said counter electrode is constructed of a member defining at least a part of the bottom surface of said developer receptacle.

7. In an apparatus for developing a latent electrostatic image, said apparatus being of the type comprising a developer receptacle containing a developer composed of carrier particles and toner particles, a developer applying mechanism for holding on its surface a part of the developer in the developer receptacle and applying it to a latent electrostatic image to be developed, a toner receptacle containing toner particles, and a toner supplying mechanism to be selectively operated to supply toner particles to the developer in the developer receptacle from the toner receptacle, the improvement wherein said apparatus further comprises:

detecting means for detecting the electrical conductivity of the developer in said developer receptacle;

toner supplying signal producing means for, when the electrical conductivity of the developer detected by said detecting means exceeds a predetermined toner supplying reference value, producing a signal for operating said toner supplying mechanism; and carrier degradation signal producing means for, when said toner supplying signal producing means does not continue to produce said signal in spite of the fact that the latent electrostatic image has been developed a predetermined number of times, producing a signal showing that the carrier particles in the developer have been degraded.

8. The apparatus of claim 7, wherein said detecting means includes a voltage source for applying a predetermined voltage to said developer applying mechanism, and a counter electrode located opposite to said developer applying mechanism, with the developer existing between said developer applying mechanism and said counter electrode.

9. The apparatus of claim 8, wherein said counter electrode is constructed of a brush length-setting member for setting the amount of the developer to be held on the surface of said developer supplying mechanism.

10. The apparatus of claim 8, wherein said counter electrode is constructed of a member defining at least a part of the bottom surface of said developer receptacle.

* * * * *